US007349658B2

(12) United States Patent
Ogata et al.

(10) Patent No.: US 7,349,658 B2
(45) Date of Patent: Mar. 25, 2008

(54) IMAGE FORMING APPARATUS THAT HAS A FULL-COLOR MODE AND A MONOCOLOR MODE, AND IMAGE FORMING APPARATUS THAT CAN ADJUST THE LENGTH OF A NON-IMAGE FORMING REGION DURING MODE SWITCHING STATE

(75) Inventors: Hiroaki Ogata, Mishima (JP); Yuki Nishizawa, Susono (JP); Eiichiro Teshima, Ashigarakami-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 11/295,077

(22) Filed: Dec. 6, 2005

(65) Prior Publication Data

US 2006/0127139 A1 Jun. 15, 2006

(30) Foreign Application Priority Data

Dec. 10, 2004 (JP) ..... 2004-358565

(51) Int. Cl.
*G03G 15/01* (2006.01)
*G03G 15/16* (2006.01)
*G03G 15/00* (2006.01)

(52) U.S. Cl. ..... 399/299; 399/66; 399/82; 399/303

(58) Field of Classification Search ..... 399/82, 399/85, 66, 297, 298, 299, 300, 301, 302, 399/303

See application file for complete search history.

(56) References Cited

U.S. PATENT DOCUMENTS 6,738,594 B2 * 5/2004 Nakagawa et al. ..... 399/299
6,963,715 B2 11/2005 Kanekura

FOREIGN PATENT DOCUMENTS

JP 2004-4398 A 1/2004

* cited by examiner

*Primary Examiner*—Hoang Ngo
(74) *Attorney, Agent, or Firm*—Canon U.S.A. Inc I.P. Div

(57) ABSTRACT

An image forming apparatus includes a plurality of photosensitive drums, a plurality of developing devices, an intermediate transfer medium, primary transfer members, and a secondary transfer member for transferring toner images onto a transfer material. A full-color mode and a monocolor mode are selectively carried out. The image forming apparatus also includes a CPU for adjusting the length of a non-image forming region, and an intermediate-transfer-medium movement controller. The CPU brings about a switching state in which an image forming region lies between a primary transfer position on the most downstream one of the photosensitive drums and a secondary transfer position and in which non-image forming regions simultaneously lie at the primary transfer position and at the secondary transfer position. The intermediate-transfer-medium movement controller switches between the full-color mode and the monocolor mode during the switching state.

6 Claims, 11 Drawing Sheets

IMAGE FORMING APPARATUS THAT HAS A FULL-COLOR MODE AND A MONOCOLOR MODE, AND IMAGE FORMING APPARATUS THAT CAN ADJUST THE LENGTH OF A NON-IMAGE FORMING REGION DURING MODE SWITCHING STATE

BACKGROUND OF THE INVENTION

1. Field of the Invention

The present invention relates to an image forming apparatus using electrophotography, such as an electrophotographic copying machine, an electrophotographic printer (e.g., a laser beam printer or an LED printer), a facsimile apparatus, and a word processor.

2. Description of the Related Art

As an image forming apparatus using electrophotography, an inline-type image forming apparatus using an intermediate transfer medium is known which forms a full-color image by a plurality of color toner images. In the inline-type image forming apparatus, for example, image forming stations 10Y, 10M, 10C, and 10Bk corresponding to a plurality of colors are respectively constituted by developing means, electrophotographic photosensitive drums 1Y, 1M, 1C, and 1Bk serving as first image bearing members, and process means that act on the drums, as shown in FIG. 9. The image forming stations 10Y, 10M, 10C, and 10Bk are arranged in a line so as to oppose an intermediate transfer medium 7 serving as a second image bearing member. Toner images of different colors are transferred one on another onto the intermediate transfer medium 7, and are transferred together onto a transfer material 13 by a secondary transfer means 8. This method is widely used because good output can be obtained, regardless of the type of the transfer material, and speedy formation of color images is possible.

When a monocolor image is formed in this image forming apparatus, the photosensitive drums 1Y, 1M, and 1C in the color-image forming stations 10Y, 10M, and 10C can be separated from the intermediate transfer medium 7 without rotation of the drums, as shown in FIG. 10. In this case, the use of the photosensitive drums 1Y, 1M, and 1C is avoided during formation of a monocolor image.

Japanese Patent Laid-Open No. 2004-4398 proposes a separation means that separates photosensitive drums Y, M, C, and Bk from an intermediate transfer belt in order to reduce the use of the photosensitive drums. Separation is performed after primary transfer of all toner images to be transferred onto the last sheet in one print job is completed, before the toner images are subjected to secondary transfer, and after secondary transfer onto the last second sheet is completed.

In the related art, however, a toner image must not lie at the second transfer position during separation, and therefore, there is a need to prohibit formation of a toner image for a period longer than the time for which the separating operation is completed.

It is common to connect a printer or a copying machine having a printer function to a network, and as a result, a plurality of users sometimes simultaneously make various print requests. For this reason, it is necessary to print a full-color image during a monocolor print mode, or conversely, to print a monocolor image during the full-color print mode.

In this case, switching between the modes must be performed so that image defects, such as color misregistration, are not caused by the influence of the operation of moving the intermediate transfer medium and the color-image forming stations into contact with or apart from each other.

That is, when the full-color mode is switched to a monocolor mode, the intermediate transfer medium and the color-image forming stations must be separated while a full-color image formed on the intermediate transfer medium does not lie at a primary transfer position in the black-image forming station and at a secondary transfer position. Similarly, when a monocolor mode is switched to the full-color mode, the intermediate transfer medium and the color-image forming stations must be brought into contact with each other while a monocolor image does not lie at the primary transfer position in the black-image forming station and at the secondary transfer position.

However, in normal continuous image formation, the non-image forming region on which a toner image is not formed (a region between image forming regions on which toner images are formed) is normally made small in order to maximize the number of prints to be continuously made. In most cases, the period in which image formation is prohibited is shorter than the contact or separation time of the intermediate transfer medium. For this reason, it is impossible that an image does not lie at both the primary transfer position in the black-image forming station and the secondary transfer position during the contact or separation time.

Accordingly, as shown in FIGS. 11 and 12, when the full-color mode is switched to a monocolor mode, the intermediate transfer medium 7 is separated from (taken out of contact with) the color-image forming stations 10Y, 10M, and 10C after a full-color image formed on the intermediate transfer medium 7 (a monocolor image when a monocolor mode is switched to the full-color mode) passes through the secondary transfer position, and image formation in a monocolor mode is then started. Therefore, when the mode is frequently changed, the number of output images produced per unit time is reduced, and output performance is seriously reduced.

SUMMARY OF THE INVENTION

The present invention provides a full-color image forming apparatus that prevents output performance from being reduced when the color mode is switched, without causing an image defect such as color misregistration.

An image forming apparatus according to an aspect of the present invention includes a plurality of image forming stations that respectively have first image bearing members on which developed images of different colors are respectively formed; a second image bearing member onto which the developed images formed on the first image bearing members are sequentially transferred at primary transfer positions on the first image bearing members; a secondary transfer unit that transfers the developed images, transferred onto the second image bearing member, together onto a recording medium at a secondary transfer position; and a controller that selectively carries out a full-color mode in which a full-color image is formed with developers of a plurality of colors and a monocolor mode in which a monocolor image is formed with a developer of one color. The controller changes the length of a non-image forming region subsequent to a target image to bring about a switching state (that is, an operational state in which switching of color mode can take place) in which an image forming region lies between the primary transfer position in the most downstream one of the first image bearing members and the secondary transfer position and in which non-image forming regions simultaneously lie at the primary transfer position on the most downstream one of the first image bearing members and at the secondary transfer position. The controller switches between the full-color mode and the monocolor mode in the switching state.

According to the present invention, it is possible to provide a full-color image forming apparatus that prevents output performance from being reduced when the color mode is switched, without causing an image defect such as color misregistration.

Further features of the present invention will become apparent from the following description of exemplary embodiments with reference to the attached drawings.

DESCRIPTION OF THE EMBODIMENTS

Embodiments of the present invention will be described below with reference to the drawings.

Dimensions, materials, shapes, and arrangements of components are not limited to those described in the embodiments unless otherwise specified. Furthermore, once the materials, shapes, etc. of components have been described in the following, similar components have the same materials and shapes unless described anew.

First Embodiment

Figure 1:
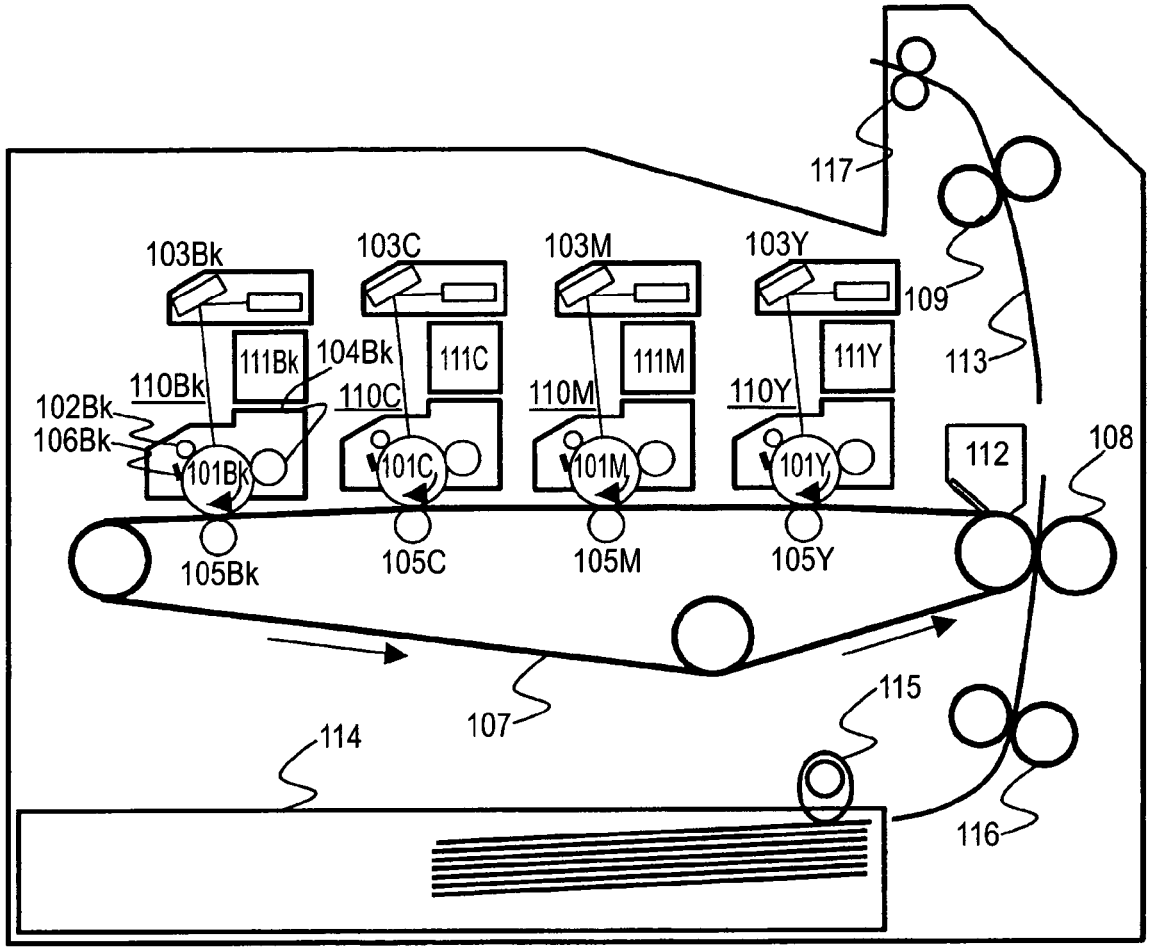
FIG. 1 is a schematic sectional view of an image forming apparatus according to a first embodiment of the present invention.

FIG. 1 is a cross-sectional view schematically showing the configuration of an image forming apparatus according to a first embodiment of the present invention. The image forming apparatus of the first embodiment includes image forming stations corresponding to a plurality of colors. Each of the image forming stations includes a first image bearing member (hereinafter referred to as a "photosensitive drum") on which an electrostatic latent image is formed, and a developing device for developing the electrostatic latent image. The image forming apparatus also includes an intermediate transfer medium serving as a second image bearing member on which color developed images on the photosensitive drums are transferred one on the other to form a full-color developed image, and a secondary transfer device serving as a secondary transfer means for transferring the full-color developed image on the intermediate transfer medium onto a transfer material serving as a recording medium.

Drum-shaped electrophotographic photosensitive members, that is, photosensitive drums 101Y, 101M, 101C, and 101Bk are supported rotatably. When an image forming operation starts, charging rollers 102Y, 102M, 102C, and 102Bk serving as charging means uniformly charge the surfaces of the photosensitive drums 101Y, 101M, 101C, and 101Bk, respectively. Subsequently, the surfaces of the photosensitive drums 101Y, 101M, 101C, and 101Bk are exposed to laser beams emitted in accordance with color image information by laser emitting means 103Y, 103M, 103C, and 103Bk serving as exposure means, thereby forming electrostatic latent images on the photosensitive drums 101Y, 101M, 101C, and 101Bk.

The photosensitive drums 101Y, 101M, 101C, and 101Bk are negatively charged. Electrostatic latent images corresponding to image information are formed on portions of the photosensitive drums 101Y, 101M, 101C, and 101Bk on which negative charges is decreased by exposure to laser light emitted from the laser emitting means 103Y, 103M, 103C, and 103Bk.

After that, with the rotation of the photosensitive drums 101Y, 101M, 101C, and 101Bk, electrostatic latent images on the photosensitive drums are respectively made visible as toner images by being developed with toner serving as a kind of developer supplied from developing devices 104Y, 104M, 104C, and 104Bk. The toner images are sequentially transferred one on another onto an intermediate transfer medium 107 at primary transfer positions, where the photosensitive drums 101Y, 101M, 101C, and 101Bk are in contact with the intermediate transfer medium 107, by primary transfer means 105Y, 105M, 105C, and 105Bk disposed correspondingly to the photosensitive drums. After transferring of the toner images, toner remaining on the surfaces of the photosensitive drums 101Y, 101M, 101C, and 101Bk is removed by cleaning devices 106Y, 106M, 106C, and 106Bk each having a blade-shaped cleaning means. Thus, the photosensitive drums 101Y, 101M, 101C, and 101Bk are put into a ready state for the next image forming operation.

The first embodiment adopts a reversal development method. Therefore, toner having the same polarity (negative) as that of the charge adheres onto the portions of the photosensitive drums 101Y, 101M, 101C, and 101Bk (image portions) on which the negative charge is decreased.

Correspondingly for each color, the photosensitive drum 101, the charging roller 102, the developing device 104, and the cleaning device 106 are combined into a process cartridge 110 (Y, M, C, and Bk) that constitutes an image forming station (Y, M, C, and Bk). Each image forming station is independently detachable from the image forming apparatus. Toner is supplied from toner supply units 111Y, 111M, 111C, and 111Bk serving as developer storing means to the developing devices 104Y, 104M, 104C, and 104Bk.

One transfer material 113 is supplied from a transfer-material cassette 114 by a supply roller 115, is brought into synchronization with the toner image on the intermediate transfer medium 107 by a registration roller 116, and is conveyed to a secondary transfer position where the intermediate transfer medium 107 is in contact with a transfer roller 108 serving as a secondary transfer means.

When the toner image on the intermediate transfer medium 107 and the transfer material 113 reach the secondary transfer position, the toner image is transferred onto the transfer material 113 by a transfer electric field produced in a transfer region by the transfer roller 108. Subsequently, the unfixed toner image on the transfer material 113 is heated by a fixing means (heat roller) and is pressed by a pressing means in a fixing device 109, and is thereby fixed as a permanent image on the transfer material 113.

In the above-described image forming apparatus, switching can be made between a contact state in which the photosensitive drums 101Y, 101M, and 101C of the process cartridges 110Y, 110M, and 110C in the color-image forming stations Y, M, and C are in contact with the intermediate transfer medium 107, and a separated state in which the drums are separated from the intermediate transfer medium 107.

Figure 2:
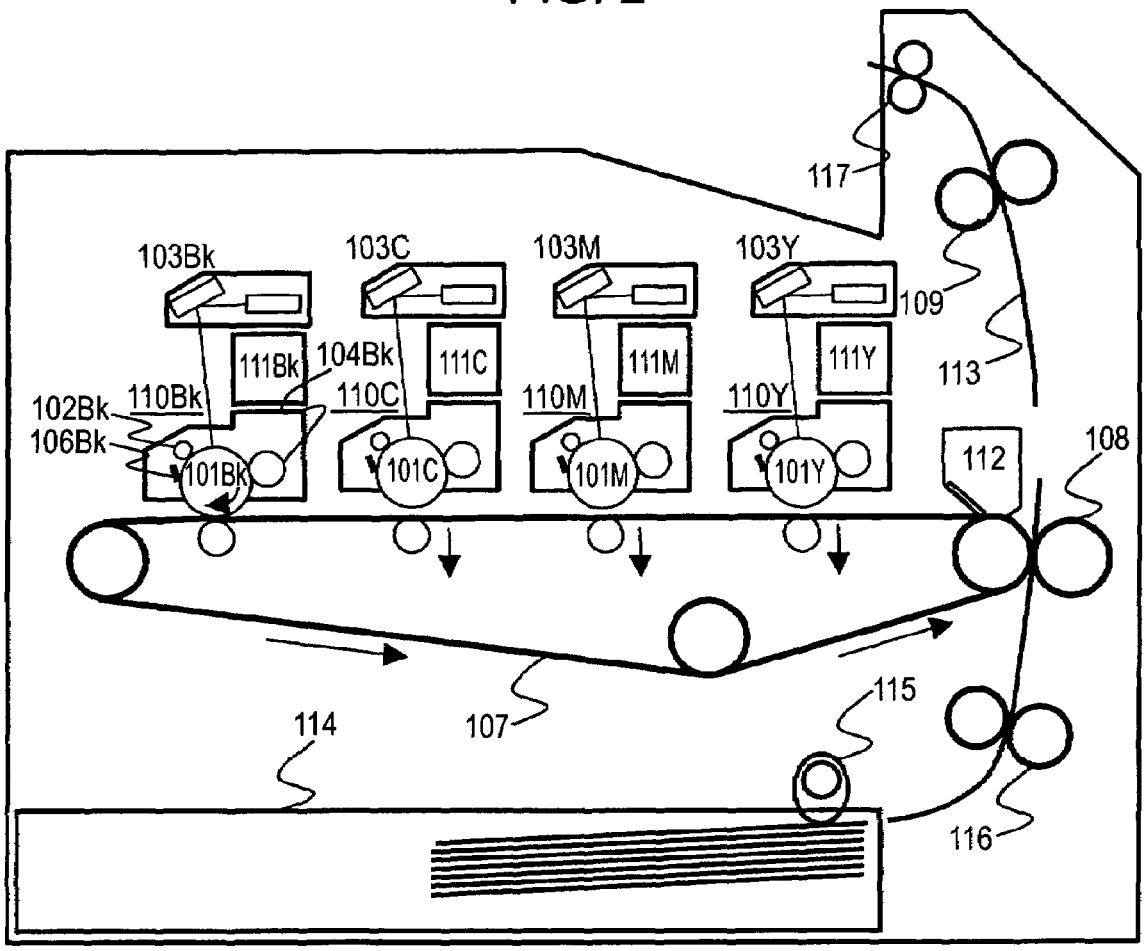
FIG. 2 is a schematic sectional view of the image forming apparatus according to the first embodiment.

That is, when a monocolor image is formed (monocolor mode), the photosensitive drums 101Y, 101M, and 101C of the process cartridges 110Y, 110M, and 110C in the unnecessary color-image forming stations Y, M, and C are separated from the intermediate transfer medium 107, as shown in FIG. 2. A monocolor-image forming operation is performed without driving the process cartridges 110Y, 110M, and 110C.

In contrast, when a full-color image is formed (full-color mode), the photosensitive drums 101Y, 101M, and 101C of the process cartridges 110Y, 110M, and 110C in the necessary color image forming stations Y, M, and C are placed in contact with the intermediate transfer medium 107. A full-color image forming operation is performed while driving the process cartridges 110Y, 110M, and 110C similarly to the process cartridge 110Bk.

In this way, the image forming apparatus operates in a "full-color mode" in which image formation is performed while the color-image forming stations are in contact with the intermediate transfer medium, and in a "monocolor mode" in which image formation is performed while the color-image forming stations are separated from the intermediate transfer medium. These modes can be selectively carried out for each page.

Figure 3:
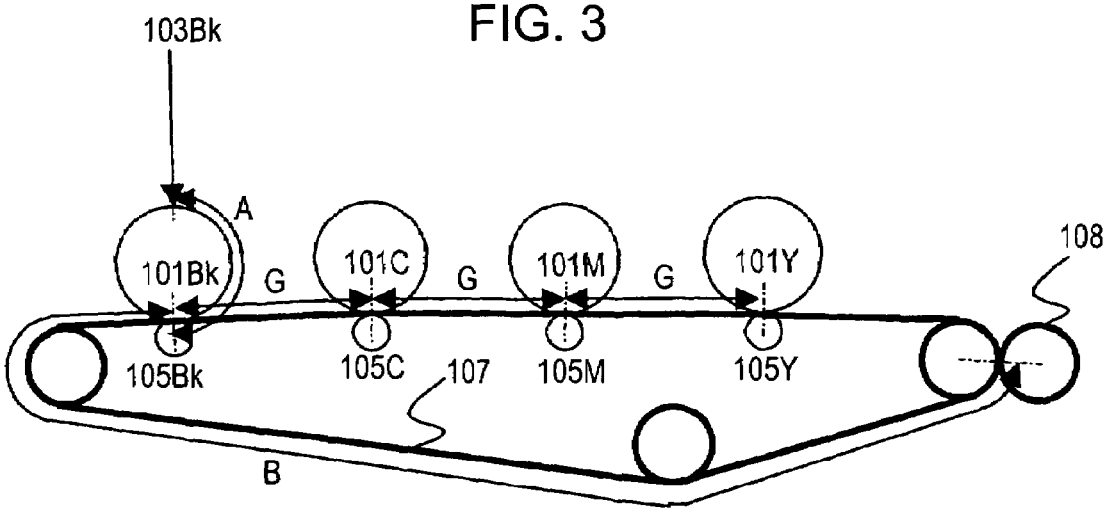
FIG. 3 is an explanatory view showing dimensions in the image forming apparatus.

In the image forming apparatus of the first embodiment, the following parameters are set (see FIG. 3).

The distance A from an exposure position (where an electrostatic latent image is formed) to the primary transfer position on the photosensitive drum 101 is 47 mm, the distance B from the primary transfer position in the most downstream image forming station Bk to the secondary transfer position is 510 mm, the length C of an image forming region (length of an A4-size sheet) is 420 mm, the length D of a normal non-image forming region in continuous image forming operation is 50 mm, the time T needed to move the intermediate transfer medium and the color-image forming stations into contact with or apart from each other is 0.5 sec, the process speed (moving speed of the surface of the intermediate transfer medium) V is 150 mm/sec, and the pitch G between the image forming stations is 80 mm. When printing on an A3-size sheet is performed while feeding the sheet in the longitudinal direction (N=1), the following condition is set:

$$B=510\text{ mm}\geqq 495\text{ mm}=C+V\times T+(C+D)\times(N-1)$$

The distance V×T for which the surface of the intermediate transfer medium moves during the operation of moving the photosensitive drums and the intermediate transfer medium into contact with or apart from each other is 75 mm.

A detailed description will now be given of control operation performed when switching the color mode in the first embodiment.

Figure 4:
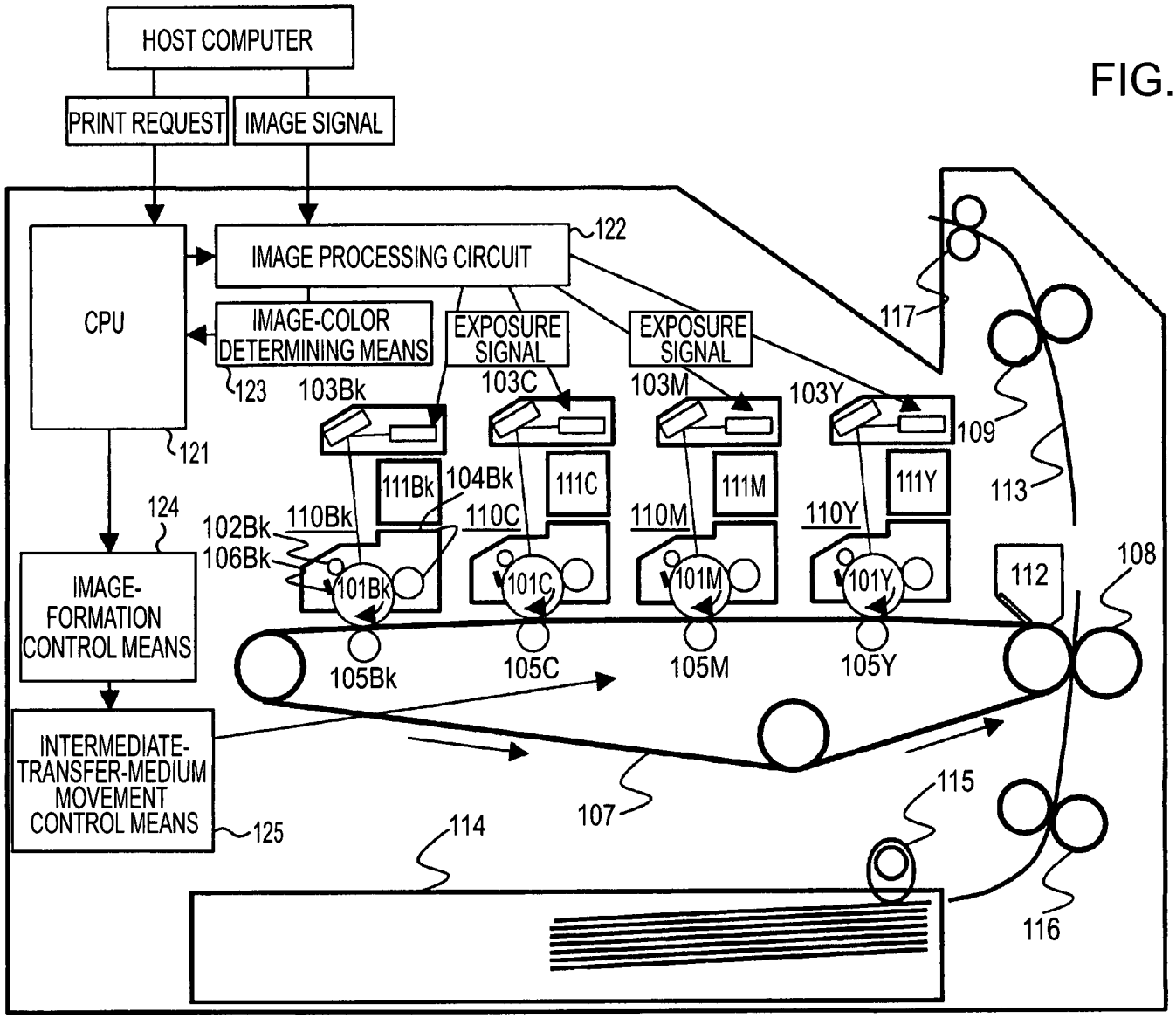
FIG. 4 is a control block diagram of the image forming apparatus.
Figure 5:
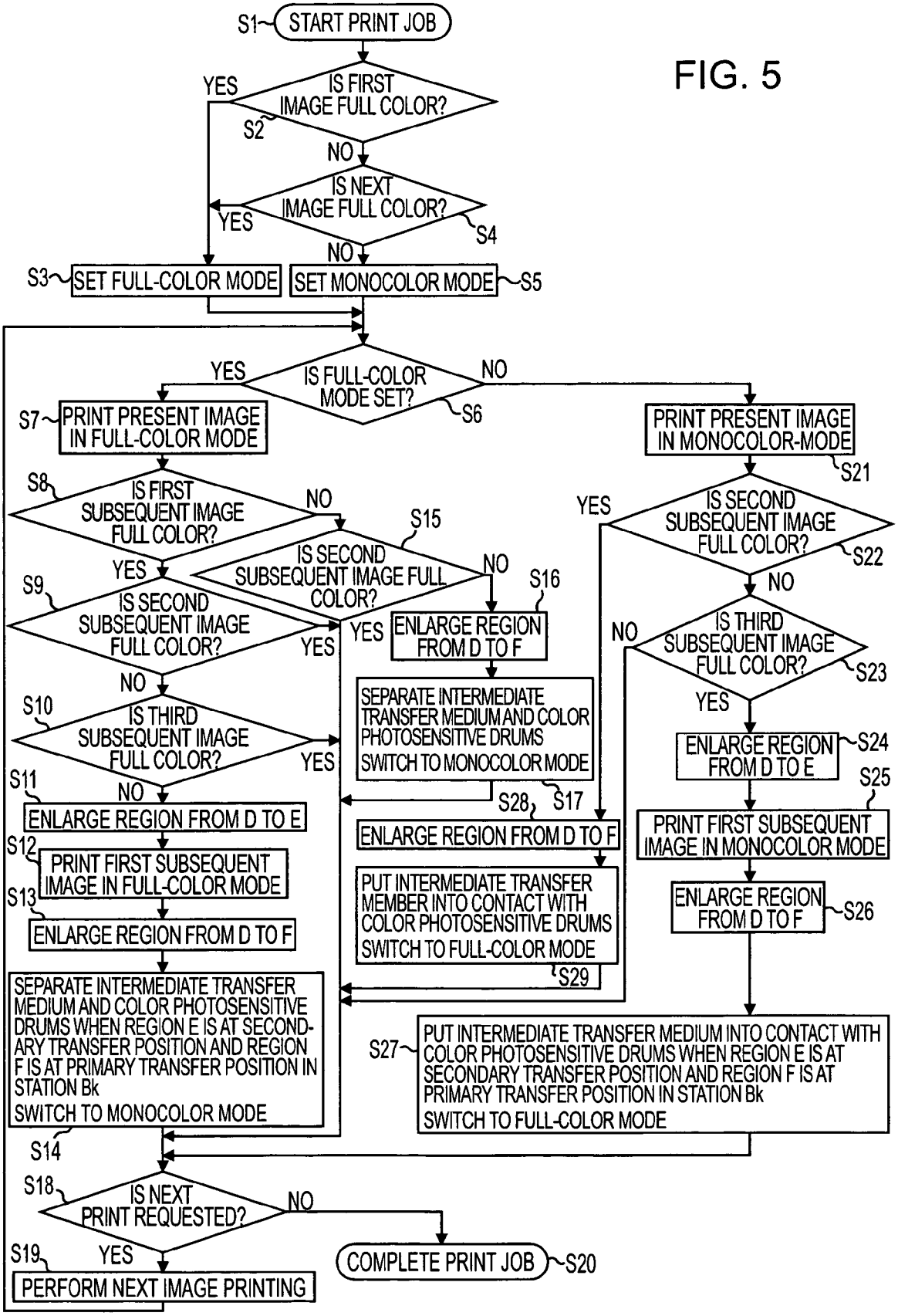
FIG. 5 is a control flowchart of the image forming apparatus.
Figure 6A:
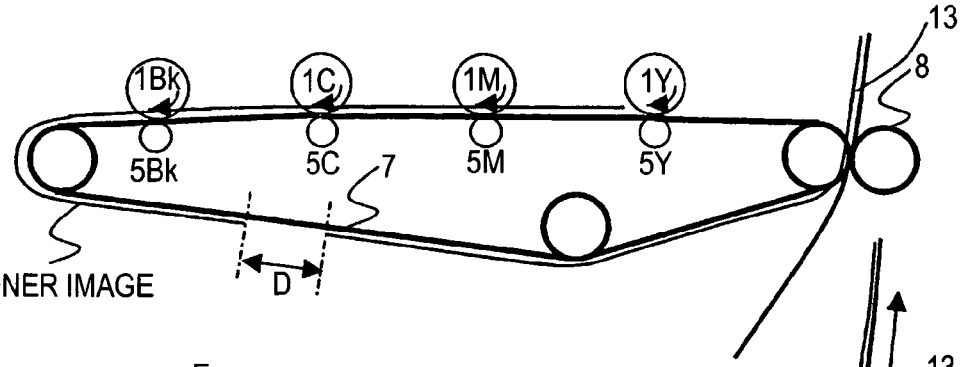
FIGS. 6A to 6D are operational diagrams of the image forming apparatus.
Figure 6B:
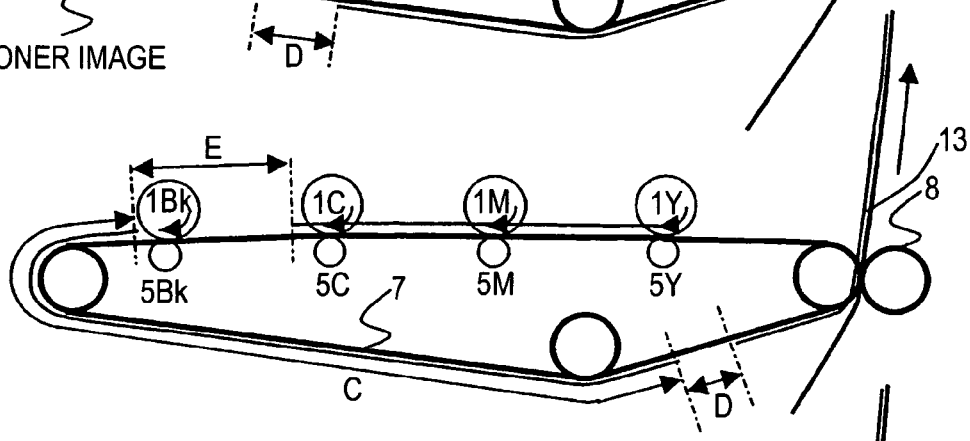
Figure 6C:
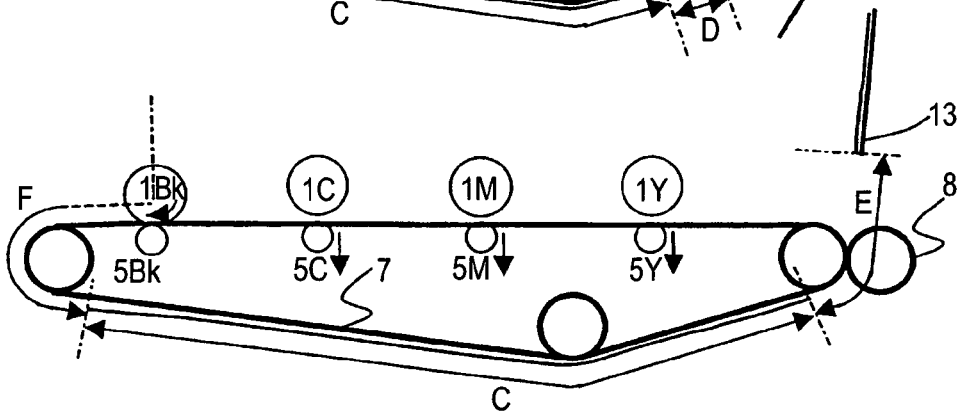
Figure 6D:
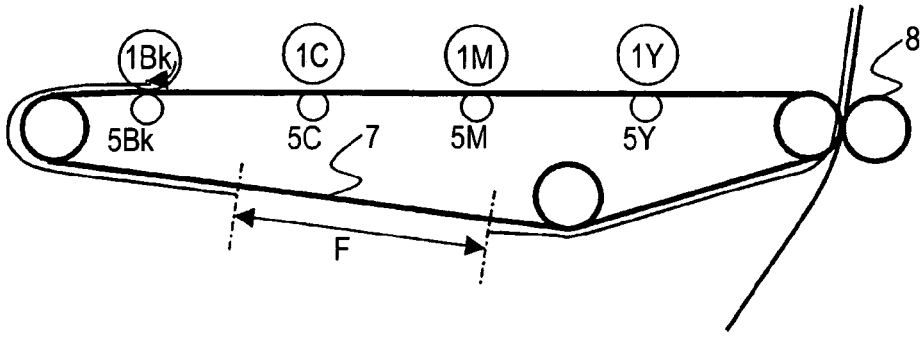
Figure 7:
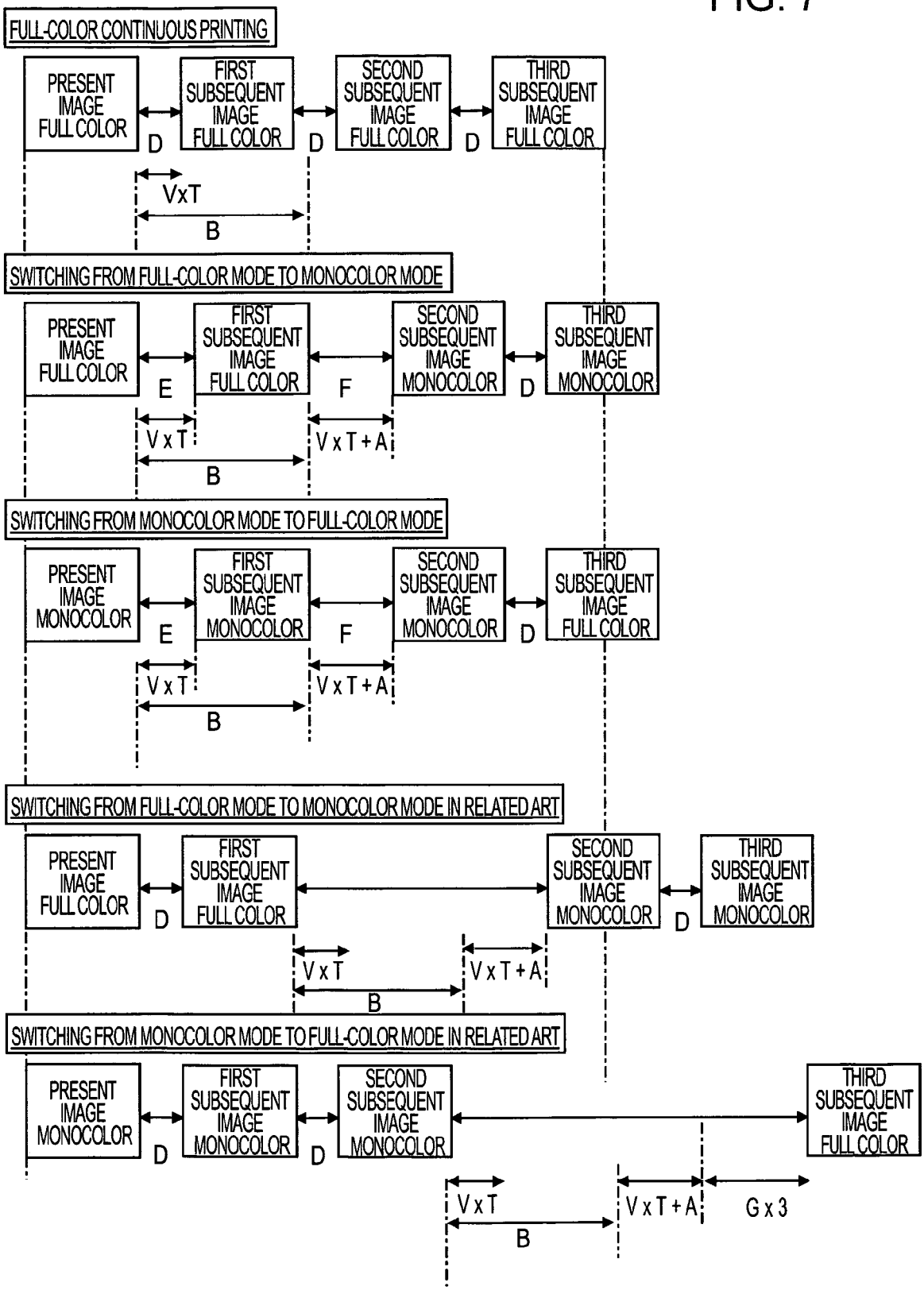
FIG. 7 is an operational diagram of the image forming apparatus.

FIG. 4 is a control block diagram of the image forming apparatus of the first embodiment, FIG. 5 is a flowchart showing the control executed when switching the color mode, and FIGS. 6 and 7 are operational diagrams.

When the image forming apparatus receives a print request from a user (host computer 120), it starts a print job (Step S1). While an image processing circuit 122 processes image data from the host computer 120 into printable image information corresponding to each color, an image-color determining means 123 determines whether the first image is full color (Step S2). When the first image is full color, the full-color mode is set (Step S3). When the first image is monocolor, it is determined whether the first subsequent image is full color or monocolor (Step S4). When the first subsequent image is full color, the full-color mode is set, similarly to the above (Step S3). When the first subsequent image is monocolor, a monocolor mode is set (Step S5). When the first color mode is set, an image forming sequence is selected correspondingly to the mode (Step S6).

In the full-color mode, formation of the present image is first started (Step S7). Then, it is determined whether each of first to third images subsequent to the present image, which is being presently printed, is full color or monocolor, and sequences are selected corresponding to the type of the image (Steps S8, S9, S10, and S15).

When all the subsequent images are full color, or when only one of the images is monocolor, the full-color continuous print state is maintained (Step S19). When only the first and second subsequent images are monocolor (this occurs only at the beginning of the print job), the non-image forming region is enlarged immediately after the first full-color image is formed (Step S16). When the non-image formation region passes through the primary transfer position in the most downstream image forming station (black-image forming station) 110Bk, the color-image forming stations Y, M, and C are separated from the intermediate transfer medium 107 by an intermediate transfer medium movement control means 125 serving as a color-mode switching means, and the color mode is switched to a monocolor mode (Step S17).

In order to prevent the transfer at the primary transfer position and formation of the next electrostatic latent image from being influenced by the separating motion, the length of the non-image forming region needs to be larger than or equal to the distance V×T+A (122 mm) obtained by adding the distance V×T (75 mm), within which the separating motion may have an influence, and the distance A (47 mm) for which the next image moves from the laser emitting means 103Bk on the photoconductive drum 101Bk to the primary transfer position. In the first embodiment, the length of the non-image forming region is increased from a normal length of 50 mm to 132 mm that is the sum of 122 mm and a margin of 10 mm.

When the first subsequent image is full color and the second and third subsequent images are monocolor, the image forming apparatus is put into a color-mode switching sequence. The color-mode switching sequence will be described below with reference to FIGS. 6A to 6D.

FIG. 6A shows a normal continuous image forming state in the full-color mode.

At the beginning of the color-mode switching sequence, first, the length of the non-image forming region subsequent to an image, which is being presently printed, is increased from a normal length D=50 mm to E=85 mm (Step S11, FIG.

6B). The enlarged non-image forming region E should be placed at the secondary transfer position when the intermediate transfer medium 107 is separated from the color-image forming stations Y, M, and C. Therefore, it is satisfactory as long as the length is set to be larger than or equal to the distance V×T=75 mm in which the separating motion has an influence on image formation. In the first embodiment, the length is set at 85 mm including a margin of 10 mm.

Subsequently, the first subsequent image is formed in the full-color mode (Step S12), and the length of the non-image forming region subsequent to the image is increased to F=137 mm (Step S13, FIG. 6C). In order to prevent the transfer at the primary transfer position and the operation of forming the next electrostatic latent image from being influenced by the separating motion, the length of the non-image forming region needs to be larger than or equal to the distance V×T+A (122 mm) obtained by adding the distance V×T (75 mm), within which the separating motion may have an influence, and the distance A (47 mm) for which the next image moves from the laser portion 103Bk on the photosensitive drum 101Bk to the primary transfer position. Also, the non-image forming region E must be placed at the secondary transfer position, and the non-image forming region F must be placed at the primary transfer position in the most downstream image forming station (black-image forming station) 110Bk. For that purpose, it is necessary to satisfy the condition that C+E+F≧A+B+V×T. After the non-image forming region E is obtained, the length of the non-image forming region F is set to be larger than or equal to A+B+V×T−C−E.

Accordingly, A+B+V×T−C−E is set at 127 mm or more. In contrast to the above-described V×T+A=122 mm, the value of 127 mm or more satisfies both the relational expressions. Therefore, the length of the non-image forming region F is set at 137 mm including a margin of 10 mm.

When the non-image forming region E passes through the secondary transfer position, and the non-image forming region F passes through the primary transfer position in the most downstream image forming station (black-image forming station) 110Bk, the intermediate transfer medium movement control means 125 separates the intermediate transfer medium 107 from the color-image forming stations Y, M, and C, and switches the color mode to a monocolor mode (Step S14, FIG. 6C).

In Step S18, when there is no request to print the next image, the print job is completed (Step S20). When a request is received, the printing operation is continued in the set color mode (Step S19).

A description will now be given of a case in which an image forming sequence for a monocolor mode is selected in Step S6.

First, the operation of printing a present image in a monocolor mode is started (Step S21). Then, it is determined whether each of second and third images subsequent to the present image is full color or monocolor, and a subsequent sequence is selected on the basis of the determination (Steps S22 and S23).

When all the images are monocolor, a continuous printing state in the monocolor mode is maintained (Step S19). When the second subsequent image is full color (this occurs only at the beginning of the print job), the non-image forming region is enlarged to a region F immediately after the first monocolor image is formed (Step S28). When the non-image forming region passes through the primary transfer position in the most downstream image forming station (black-image forming station) 110Bk, the intermediate transfer medium movement control means 125 puts the intermediate transfer medium 107 into contact with the color-image forming stations Y, M, and C, and switches the color mode to the full-color mode (Step S29).

In order to prevent the transfer at the primary transfer position and the operation of forming the next electrostatic latent image from being influenced by the contact motion, the length of the non-image forming region F needs to be larger than or equal to the distance V×T+A (122 mm) obtained by adding the distance V×T (75 mm), within which the contact motion may have an influence, and the distance A (47 mm) for which the next image moves from the laser portion 103Bk on the photosensitive drum 101Bk to the primary transfer position. In the first embodiment, the length is increased from the normal length of 50 mm to 132 mm including a margin of 10 mm.

When the first and second subsequent images are monocolor and the third subsequent image is full color, the image forming apparatus is put into a color-mode switching sequence.

At the beginning of the color-mode switching sequence, the non-image forming region subsequent to an image, which is presently being printed, is enlarged from a normal image-forming region D (50 mm) to E (85 mm) (Step S24). Since the non-image forming region E should be placed at the secondary transfer position when the intermediate transfer medium 107 is moved into contact, the length thereof is set to be larger than or equal to the distance V×T=75 mm within which the contact motion may have an influence. In the first embodiment, the length is set at 85 mm including a margin of 10 mm.

Then, the first subsequent image is printed in the monocolor mode (Step S25), and the non-image forming region just subsequent to the image is enlarged to F (138 m) (Step S26). In order to prevent the transfer at the primary transfer position and the operation of forming the next electrostatic latent image from being influenced by the contact motion, the length of the non-image forming region F needs to be larger than or equal to the distance V×T+A (122 mm) obtained by adding the distance V×T (75 mm), within which the contact motion may have an influence, and the distance A (47 mm) for which the next image moves from the laser portion 103Bk on the photosensitive drum 101Bk to the primary transfer position. Also, the non-image forming region E should be placed at the secondary transfer position, and the non-image forming region F should be placed at the primary transfer position in the most downstream image forming station (black-image forming station) 110Bk. For that purpose, it is necessary to satisfy the condition that C+E+F≧A+B+V×T. After the non-image forming region E is obtained, the length of the non-image forming region F is set to be larger than or equal to A+B+V×T−C−E.

Accordingly, A+B+V×T−C−E is set to be 127 mm or more. In contrast to the above-described V×T+A=122 mm, the value of 127 mm or more satisfies both the relational expressions. Therefore, the length of the non-image forming region F is set at 137 mm including a margin of 10 mm.

When the non-image forming region E passes through the secondary transfer position, and the non-image forming region F passes through the primary transfer position in the most downstream image forming station (black-image forming station) 110Bk, the intermediate transfer medium movement control means 125 brings the intermediate transfer medium 107 into contact with the color image forming stations Y, M, and C, and switches the color mode to the full-color mode (Step S27).

In Step S18, when there is no request to print the next image, the print job is completed (Step S20). When a request is received, the printing operation is continued in the set color mode (Step S19).

The color-mode switching operation is controlled in the above-described manner.

The above-described configuration and control substantially reduce the time needed to switch the color mode. In this respect, the first embodiment will be compared with the related art, with reference to FIG. 7.

Referring to FIG. 7, in contrast to the case in which four full-color images are continuously printed according to the first embodiment (or monocolor images are similarly printed), when the color mode is switched from the full-color mode to a monocolor mode and from a monocolor mode to the full-color mode in the related art, the length of one non-image forming region is much larger than the length of a normal non-image forming region D. The length is determined in consideration of the distance for which the image completely passes through the secondary transfer position, and the influence of movement of the intermediate transfer medium. Therefore, $B+V\times T+A$ is added when the full-color mode is switched to the monocolor mode, and the distance $G\times 3$ for which the color-image forming stations move is further added. Consequently, the length needs to be at least $B+V\times T+A+G\times 3$. If this is applied to the image forming apparatus of the first embodiment, the length is 632 mm (increased by 582 mm/3.88 sec compared with continuous printing) when the full-color mode is switched to the monocolor mode, and 872 mm (increased by 822 mm/5.48 sec compared with continuous printing) when the monocolor-mode is switched to the full-color mode.

In contrast, in the first embodiment, the lengths of two non-image forming regions are increased from D to E and from D to F in both switching sequences (full-color to monocolor and monocolor to full-color). The increases are substantially limited to $E+F-D\times 2=85+137-50\times 2=123$ mm, which is 0.81 sec in time.

Consequently, when both full-color images and monocolor images are mixed, or when a plurality of users print various images through a network, the time for which the user waits for the color mode to be switched is substantially reduced. This achieves a more user-friendly printing environment.

Moreover, since the drum rotations of the image forming stations (process cartridges) can be reduced by shortening the switching time, the use of expendables can be reduced.

The length of the non-image forming region is adjusted by a CPU 121 serving as a non-image-forming-region length adjusting means.

Second Embodiment

The structure dimensions and image dimensions described in the above first embodiment allow one image to be provided within the distance B from the primary transfer position in the most downstream image forming station (Bk) to the secondary transfer position. In contrast, when two or more small images are provided, or when two or more images are provided because the distance B is long, the advantages of the first embodiment can also be provided by defining the number N of images that can be provided within the distance B.

The distance from the exposure position to the primary transfer position on each photosensitive drum 101 is designated as A, the distance from the primary transfer position in the most downstream image forming station to the secondary transfer position is designated as B, the length of the image forming region is designated as C, the length of the normal non-image forming region during continuous image formation is designated as D, the time required to move the intermediate transfer medium and the color-image forming stations into contact with or apart from each other is designated as T, the process speed (moving speed of the surface of the intermediate transfer medium) is designated as V, and the distance for which the surface of the intermediate transfer medium moves during the contact or separating operation is designated as $V\times T$.

Figure 8:
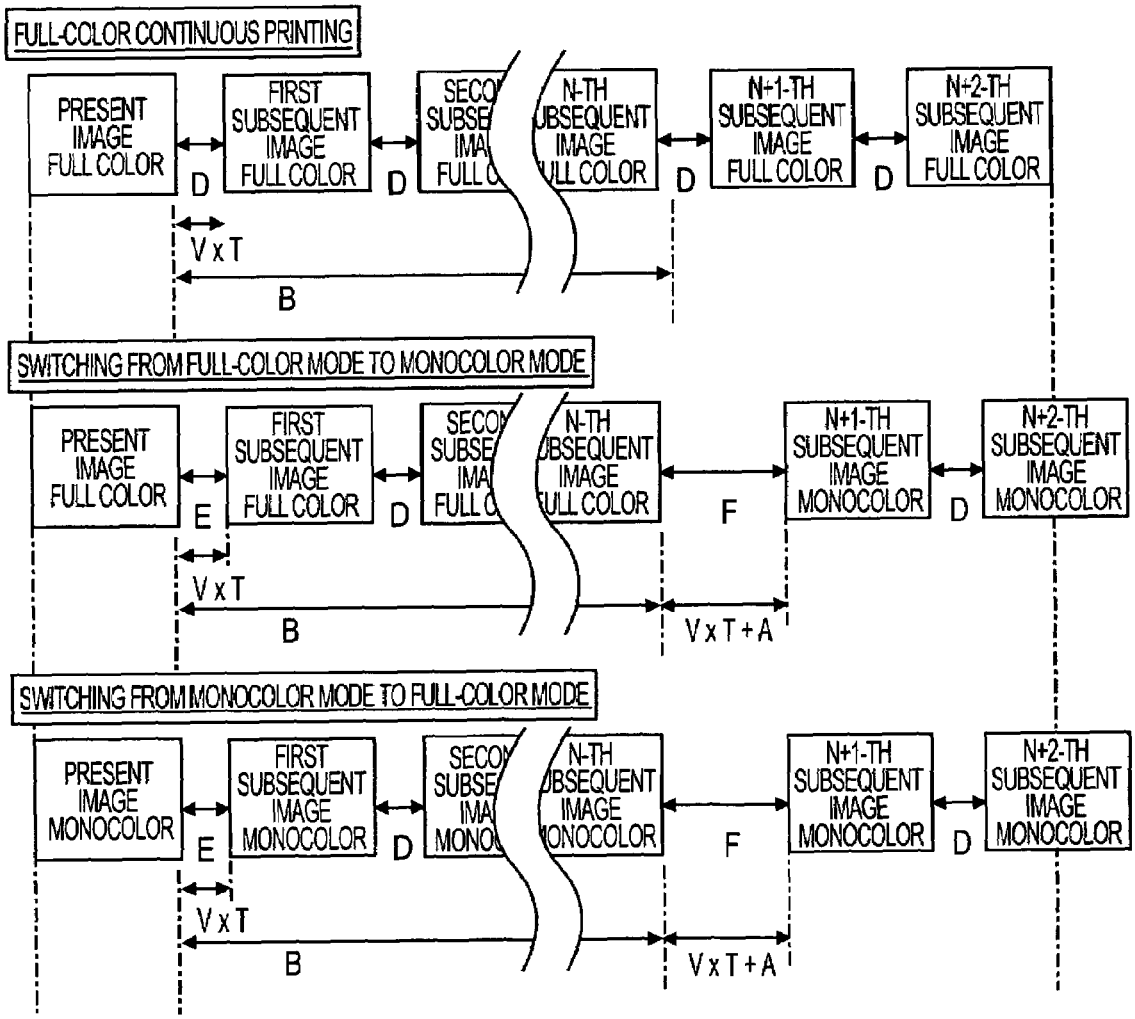
FIG. 8 is an operational diagram of an image forming apparatus according to a second embodiment of the present invention.
Figure 9:
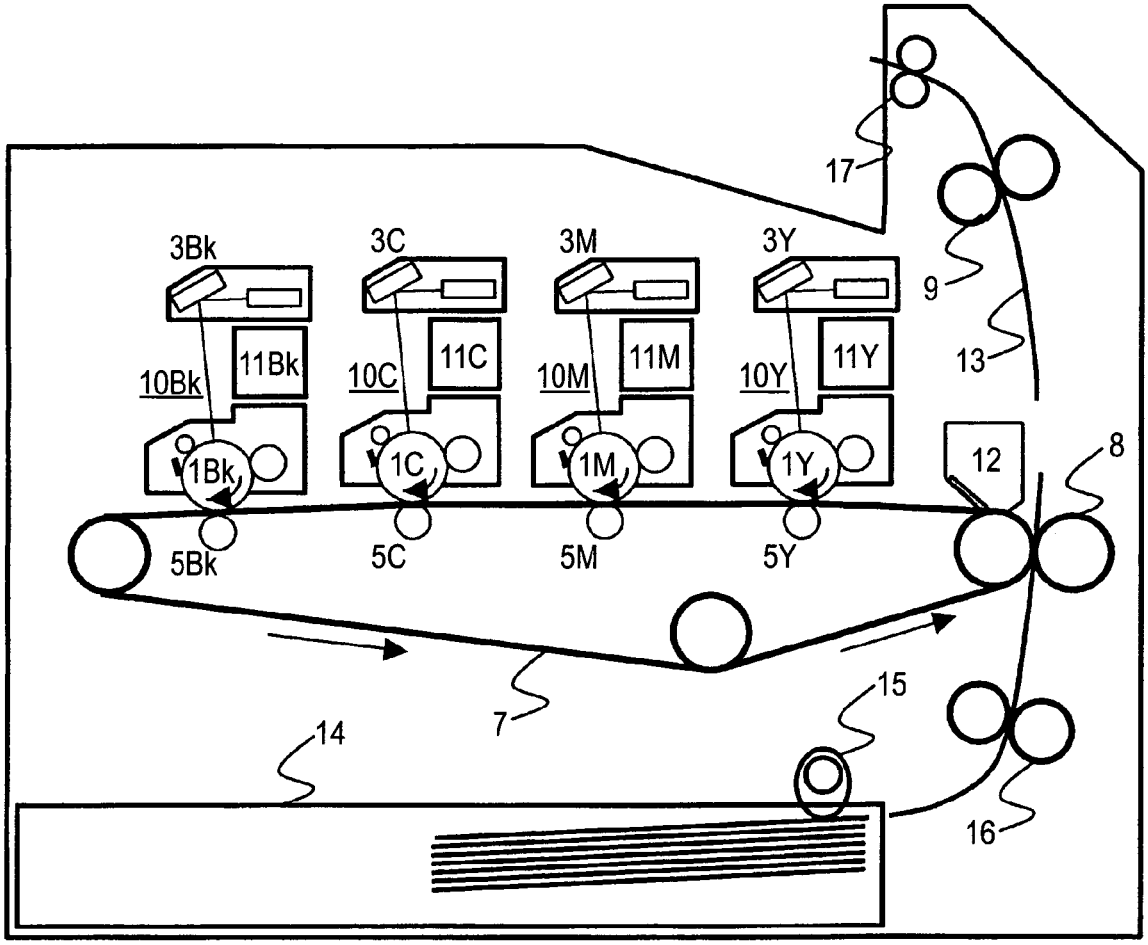
FIG. 9 PRIOR ART
FIG. 9 is a schematic sectional view of a known image forming apparatus.
Figure 10:
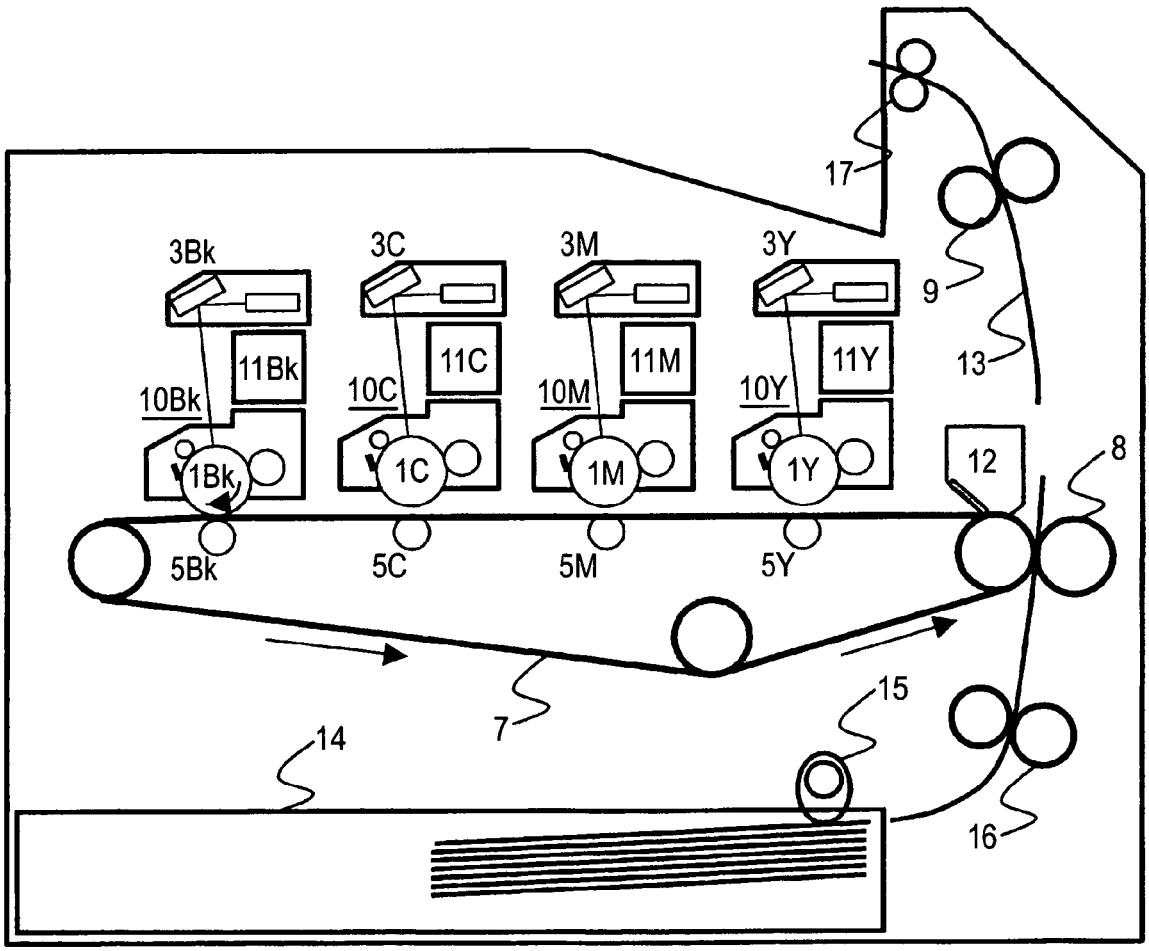
FIG. 10 PRIOR ART
FIG. 10 is a schematic sectional view of the known image forming apparatus.
Figure 11A:
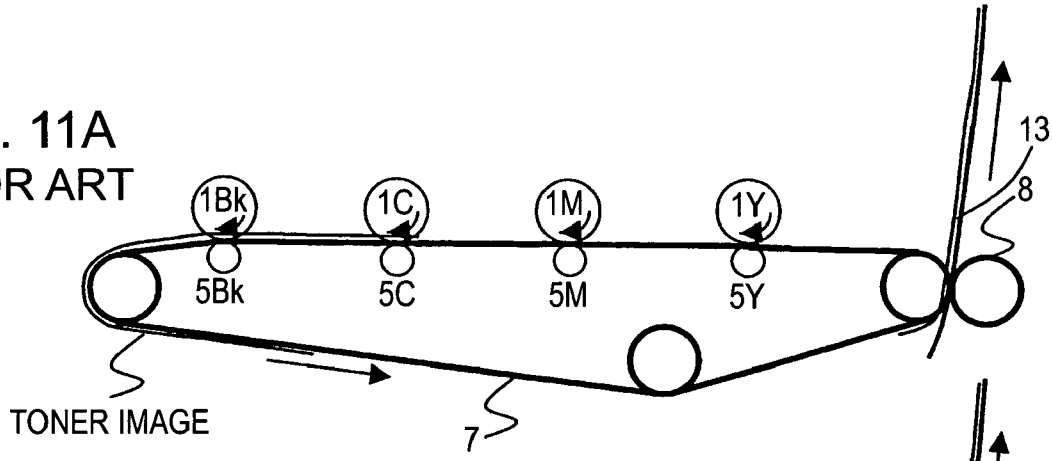
FIG. 11A PRIOR ART
FIGS. 11A to 11D are operational diagrams of the known image forming apparatus.
Figure 11B:
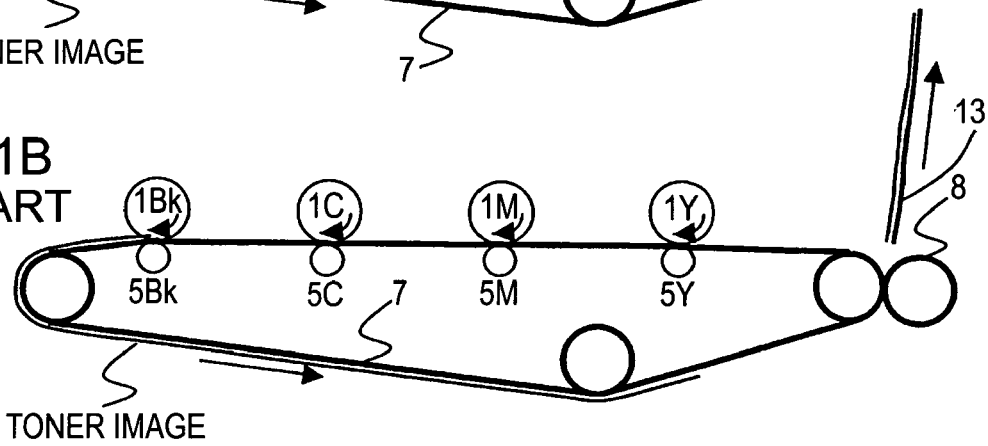
FIG. 11B PRIOR ART
Figure 11C:
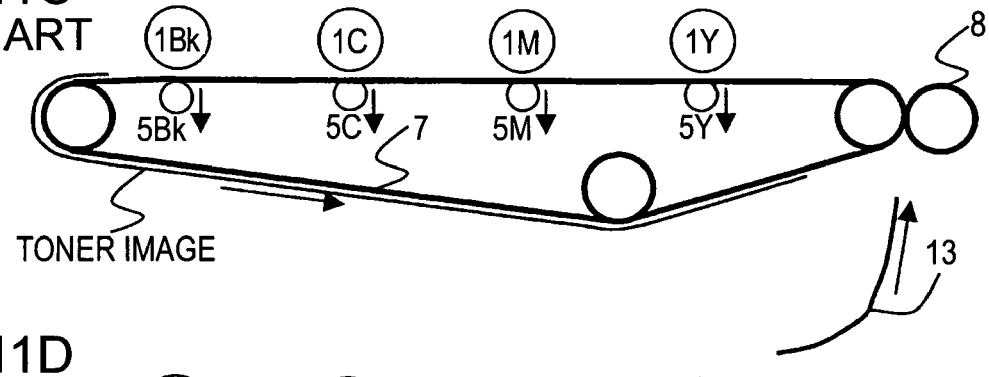
FIG. 11C PRIOR ART
Figure 11D:
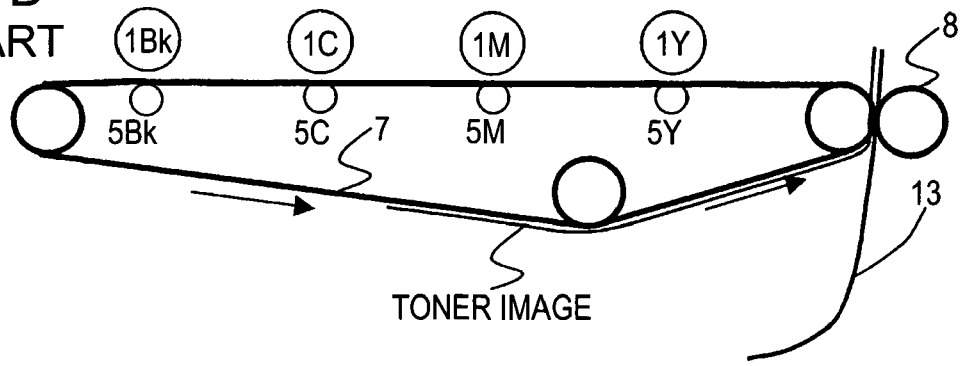
FIG. 11D PRIOR ART
Figure 12A:
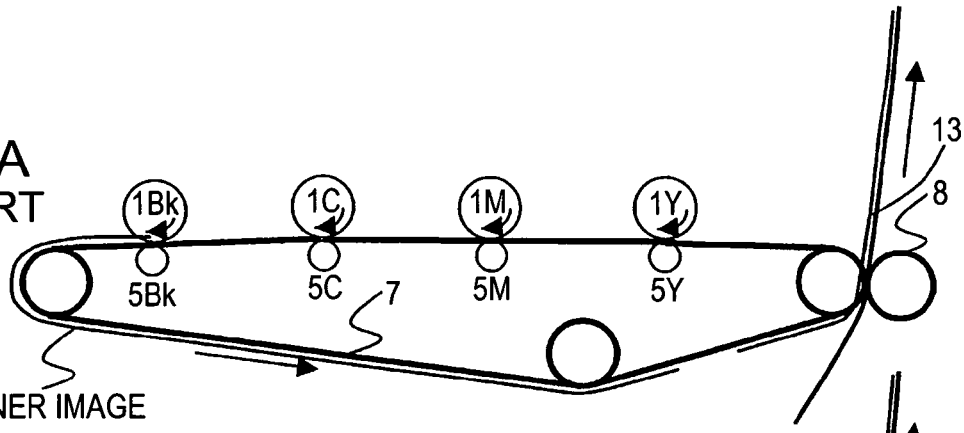
FIG. 12A PRIOR ART
FIGS. 12A to 12D are operational diagrams of the known image forming apparatus.
Figure 12B:
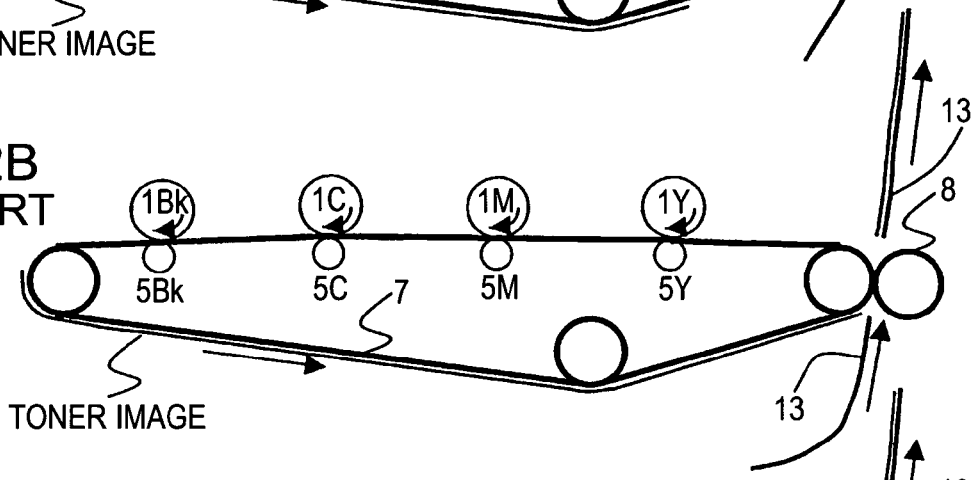
FIG. 12B PRIOR ART
Figure 12C:
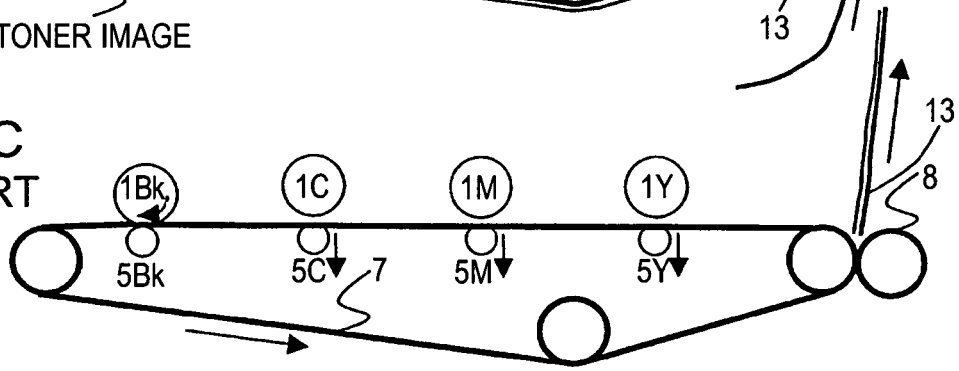
FIG. 12C PRIOR ART
Figure 12D:
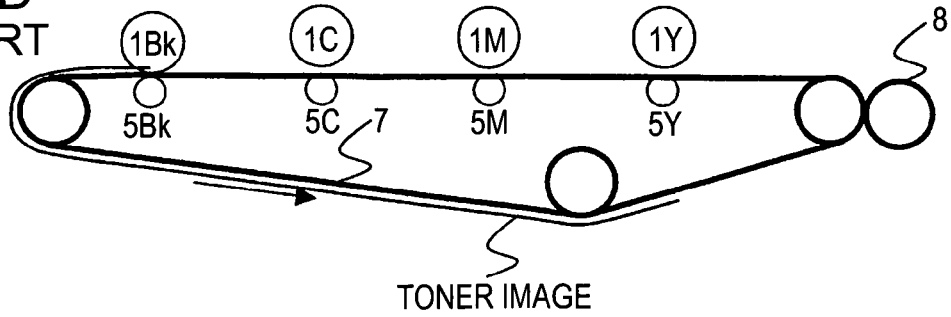
FIG. 12D PRIOR ART

In this case, it is determined whether the conditions that $B\geqq C+V\times T+(C+D)\times(N-1)$, that $C\times N+E+F\geqq A+B+V\times T$, that $E\geqq V\times T$, and that $F\geqq V\times T+A$ are satisfied, and whether each of the first to N+2-th subsequent images subsequent to the presently printed image is full color or monocolor. When the full-color mode is selected and the N+1-th and N+2-th subsequent images are monocolor, the length of the non-image forming region subsequent to the present image and the length of the non-image forming region subsequent to the N-th subsequent image are increased, as shown in FIG. 8. Consequently, the enlarged non-image forming region lies between the secondary transfer position and the primary transfer position in the most downstream image forming station. In this state, the intermediate transfer medium is separated from the color-image forming stations. In contrast, when a monocolor mode is presently set, and the N+2-th subsequent image subsequent to the present image is full color, the non-image forming region subsequent to the present image and the non-image forming region subsequent to the N-th subsequent image are similarly enlarged, as shown in FIG. 8. Consequently, the enlarged non-image forming region lies between the secondary transfer position and the primary transfer position in the most downstream image forming station. In this state, the intermediate transfer medium is brought into contact with the color-image forming stations. By these operations, advantages similar to those of the first embodiment can be achieved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-358565 filed Dec. 10, 2004, which is hereby incorporated by reference herein in its entirety.

What is claimed is:

1. An image forming apparatus comprising:

a plurality of image forming stations that each have a respective first image bearing member on which a developed image of a respective one of a plurality of different colors is formed;

a second image bearing member on which the developed images formed on the first image bearing members are sequentially transferred at primary transfer positions on the first image bearing members;

a secondary transfer unit that transfers the developed images, transferred onto the second image bearing member, together onto a recording medium at a secondary transfer position; and a controller that selectively carries out a full-color mode in which a full-color image is formed with developers of a plurality of colors onto the second image bearing member and a monocolor mode in which a monocolor image is formed with a developer of one color onto the second image bearing member, wherein, when the controller switches between the full-color mode and the monocolor mode, the controller changes the length of a non-image forming region that does not form the full-color image and the monocolor image onto the second image bearing member, and makes a first switching state in which the full-color image or the monocolor image lies between the primary transfer position on the first image bearing member in the most downstream that transfer the image to the second image bearing member at the end among the first image bearing members and the secondary transfer position and in which the non-image forming regions simultaneously lie at the primary transfer position on the most downstream and at the secondary transfer position.

2. The image forming apparatus according to claim 1, wherein the following conditions are satisfied:

$$B \geqq C+V\times T$$

$$E \geqq V\times T$$

$$F \geqq V\times T+A$$

$$C+E+F \geqq A+B+V\times T$$

where A represents the distance from the position where an electrostatic latent image is formed to the primary transfer position on each of the first image bearing members, B represents the distance from the primary transfer position on the first image bearing member in the most downstream to the secondary transfer position, C represents the length of an image forming region, E represents the length of the non-image forming region lying at the secondary transfer position during the first switching state, F represents the length of the non-image forming region lying at the primary transfer position on the first image bearing member in the most downstream during the first switching state, T represents the time needed to move the first image bearing members and the second image bearing member into contact with or apart from each other, and V represents the speed at which the surface of the second image bearing member moves.

3. The image forming apparatus according to claim 2, wherein D represents the normal length of the non-image forming regions in continuous image forming operation, wherein the image forming region lying between the primary transfer position on the first image bearing member in the most downstream and the secondary transfer position includes a number N of image forming regions, wherein the following condition is satisfied:

$$B \geqq C+V\times T+(C+D)\times(N-1)$$

where N represents an integer indicating the number of the image forming regions, wherein the controller determines whether each of the N+1-th to N+2-th subsequent images subsequent to an image formed on the second image bearing member is full color or monocolor, wherein, when the full-color mode is selected and the N+1-th and N+2-th subsequent images are monocolor, the length of the non-image forming region subsequent to the image formed on the second image bearing member is increased to bring about a second switching state in which the number N of image forming regions lie between the primary transfer position on the first image bearing member in the most downstream and the secondary transfer position and the non-image forming regions simultaneously lie at the primary transfer position on the first image bearing member in the most downstream and at the secondary transfer position, and wherein the second image bearing member and any of the first image bearing members that are unnecessary for the monocolor mode are separated during the second switching state.

4. The image forming apparatus according to claim 2, wherein the following condition is satisfied:

$$B \geqq C+V\times T,$$

wherein the controller determines whether each of the first to third subsequent images subsequent to an image formed on the second image bearing member is full color or monocolor, wherein, when the full-color mode is selected and the second and third subsequent images are monocolor, the length of the non-image forming region subsequent to the image formed on the second image bearing member is increased to bring about the first switching state, and wherein the second image bearing member and any of the first image bearing members that are unnecessary for the monocolor mode are separated during the first switching state.

5. The image forming apparatus according to claim 2, wherein D represents the normal length of the non-image forming regions in continuous image forming operation, wherein the image forming region lying between the primary transfer position on the first image bearing member in the most downstream and the secondary transfer position includes a number N of image forming regions, wherein the following condition is satisfied:

$$B \geqq C+V\times T+(C+D)\times(N-1)$$

where N represents an integer indicating the number of the image forming regions, wherein the controller determines whether each of the N+1-th to N+2-th subsequent images subsequent to an image formed on the second image bearing member is full color or monocolor, wherein, when the monocolor mode is selected and the N+2-th subsequent image is full color, the length of the non-image forming region subsequent to the image formed on the second image bearing member is increased to bring about a second switching state in which the number N of image forming regions lie between the primary transfer position on the first image bearing member in the most downstream and the secondary transfer position and the non-image forming regions simultaneously lie at the primary transfer position on the first image bearing member in and at the secondary transfer position, and wherein the second image bearing member and any of the first image bearing members that are necessary for the full-color mode are brought into contact with each other during the second switching state.

6. The image forming apparatus according to claim 2, wherein the following condition is satisfied:

$$B \geqq C + V \times T,$$

wherein the controller determines whether each of the first to third subsequent images subsequent to an image formed on the second image bearing member is full color or monocolor, wherein, when the monocolor mode is selected and the third subsequent image is full color, the length of the non-image forming region subsequent to the image formed on the second image bearing member is increased to bring about the first switching state, and wherein the second image bearing member and any of the first image bearing members that are necessary for the full-color mode are brought into contact with each other during the first switching state.

* * * * *